US007413401B2

(12) United States Patent
Szucs et al.

(10) Patent No.: US 7,413,401 B2
(45) Date of Patent: Aug. 19, 2008

(54) METHODS AND APPARATUS FOR CONTROLLING VARIABLE STATOR VANES

(75) Inventors: Peter N. Szucs, West Chester, OH (US); Andrew Breeze-Stringfellow, Montgomery, OH (US)

(73) Assignee: General Electric Company, Schenectady, NY (US)

( * ) Notice: Subject to any disclaimer, the term of this patent is extended or adjusted under 35 U.S.C. 154(b) by 199 days.

(21) Appl. No.: 11/333,591

(22) Filed: Jan. 17, 2006

(65) Prior Publication Data

US 2007/0166150 A1 Jul. 19, 2007

(51) Int. Cl.
*F03B 3/18* (2006.01)

(52) U.S. Cl. ..... 415/162; 415/160

(58) Field of Classification Search ..... 415/160, 415/162, 164, 166
See application file for complete search history.

(56) References Cited

U.S. PATENT DOCUMENTS 2,924,375 A * 2/1960 McKissock ..... 415/149.4
5,993,152 A 11/1999 Schilling
7,037,070 B2 * 5/2006 Raine et al. ..... 415/162

* cited by examiner

*Primary Examiner*—Edward Look
*Assistant Examiner*—Dwayne J White
(74) *Attorney, Agent, or Firm*—William Scott Andes, Esq.; Armstrong Teasdale LLP

(57) ABSTRACT

An actuation system for a plurality of variable stator vanes pivotally mounted in a casing of a compressor. The system includes a plurality of levers each having a proximal end and an opposite distal end. Each of the proximal ends are fixedly coupled to a corresponding stator vane of the plurality of variable stator vanes for pivoting the corresponding stator vane about a stator vane axis. The system also includes an actuation ring coaxially surrounding the casing adjacent the plurality of levers. The actuation ring is coupled to the distal ends of each of the plurality of levers for pivoting the levers as the actuation ring is rotated about a compressor rotation axis. The actuation ring includes a pin extending outward from a radially outward surface of the actuation ring. The system also includes a template comprising a slot for receiving at least a portion of the actuation ring pin. The slot includes a shape configured to guide rotation of the actuation ring about the compressor rotation axis when the template is moved relative to the actuation ring.

20 Claims, 5 Drawing Sheets

METHODS AND APPARATUS FOR CONTROLLING VARIABLE STATOR VANES

BACKGROUND OF THE INVENTION

This invention relates generally to compressors, and more specifically to compressor variable stator vane assemblies.

In gas turbine engines, air is pressurized in a compressor and channeled to a combustor wherein it is mixed with fuel and ignited for generating hot combustion gases. The hot combustion gases flow downstream into one or more turbine stages which extract energy therefrom for powering the compressor and producing useful work. At least some known compressors have a plurality of axial stages which compress the air in turn as it flows downstream. Each compressor stage may include a row of rotor blades extending radially outwardly from a compressor spool or disk, and a cooperating row of stator vanes extending radially inwardly from an annular casing.

To control performance and stall margin of the compressor, at least some known stator vane rows are variable for selectively adjusting an angle of the vanes relative to the air being compressed. At least some known variable stator vanes include a spindle which extends radially outwardly through a casing and to which is attached a lever. The lever in turn is pivotally joined to an actuation ring coaxially surrounding the compressor casing. At least some known variable stator vane assemblies join each of the actuation rings for different variable stages to a common beam pivotally joined to the casing at one end and joined to a suitable actuator at an opposite end. The actuator pivots the beam which in turn rotates the actuation rings connected thereto which in turn rotates the respective levers attached thereto for pivoting the corresponding stator vanes. However, an amount of stator vane pivoting may vary from stage to stage since the several actuation rings are joined to the common beam at correspondingly different pivoting lengths from the pivoting end of the beam. Moreover, the common actuation beam and/or interconnections between the beam and the actuation rings may increase the complexity and/or weight of some known variable stator vane assemblies, and therefore may increase costs and maintenance.

Because gas turbine engines sometimes operate over a range of output power, the operation of the compressor may be correspondingly scheduled for maximizing efficiency of operation without undergoing undesirable aerodynamic stall. Vane scheduling is controlled by the kinematic motion of the levers, actuation rings, and actuation beam. However, at least some known variable stator vane assemblies may be limited to unidirectional tracking of the stator vanes, which may result in a compromised schedule of the stator vanes. Moreover, once at least some known variable stator vane assemblies are configured for a predetermined schedule, it may be difficult and costly to adjust the schedule.

BRIEF SUMMARY OF THE INVENTION

In one aspect, an actuation system is provided for a plurality of variable stator vanes pivotally mounted in a casing of a compressor. The system includes a plurality of levers each having a proximal end and an opposite distal end. Each of the proximal ends are fixedly coupled to a corresponding stator vane of the plurality of variable stator vanes for pivoting the corresponding stator vane about a stator vane axis. The system also includes an actuation ring coaxially surrounding the casing adjacent the plurality of levers. The actuation ring is coupled to the distal ends of each of the plurality of levers for pivoting the levers as the actuation ring is rotated about a compressor rotation axis. The actuation ring includes a pin extending outward from a radially outward surface of the actuation ring. The system also includes a template comprising a slot for receiving at least a portion of the actuation ring pin. The slot includes a shape configured to guide rotation of the actuation ring about the compressor rotation axis when the template is moved relative to the actuation ring.

In another aspect, a compressor includes a variable stator vane assembly. The variable stator vane assembly includes a plurality of variable stator vanes pivotally mounted in a casing of the compressor for rotation about a stator vane axis. The assembly also includes a plurality of levers each having a proximal end and an opposite distal end. Each of the proximal ends is fixedly coupled to a corresponding stator vane of the plurality of variable stator vanes for pivoting the corresponding stator vane about the stator vane axis. An actuation ring coaxially surrounds the casing adjacent the plurality of levers. The actuation ring is coupled to the distal ends of each of the plurality of levers for pivoting the levers as the actuation ring is rotated about a compressor rotation axis. The actuation ring includes a pin extending outward from a radially outward surface of the actuation ring. The assembly also includes a template including a slot for receiving at least a portion of the actuation ring pin. The slot includes a shape configured to guide rotation of the actuation ring about the compressor rotation axis when the template is moved relative to the actuation ring.

In another aspect, an actuation system is provided for a plurality of variable stator vanes pivotally mounted in a casing of a compressor. The system includes a plurality of levers each having a proximal end and an opposite distal end. Each of the proximal ends fixedly coupled to a corresponding stator vane of the plurality of variable stator vanes for pivoting the corresponding stator vane about a stator vane axis. The system also includes a template including a pin extending inward from a radially inward surface of the template. An actuation ring coaxially surrounds the casing adjacent the plurality of levers. The actuation ring is coupled to the distal ends of each of the plurality of levers for pivoting the levers as the actuation ring is rotated about a compressor rotation axis. The actuation ring includes a slot for receiving at least a portion of the template pin. The slot includes a shape configured to guide rotation of the actuation ring about the compressor rotation axis when the template is moved relative to the actuation ring.

DETAILED DESCRIPTION OF THE INVENTION

Figure 1:
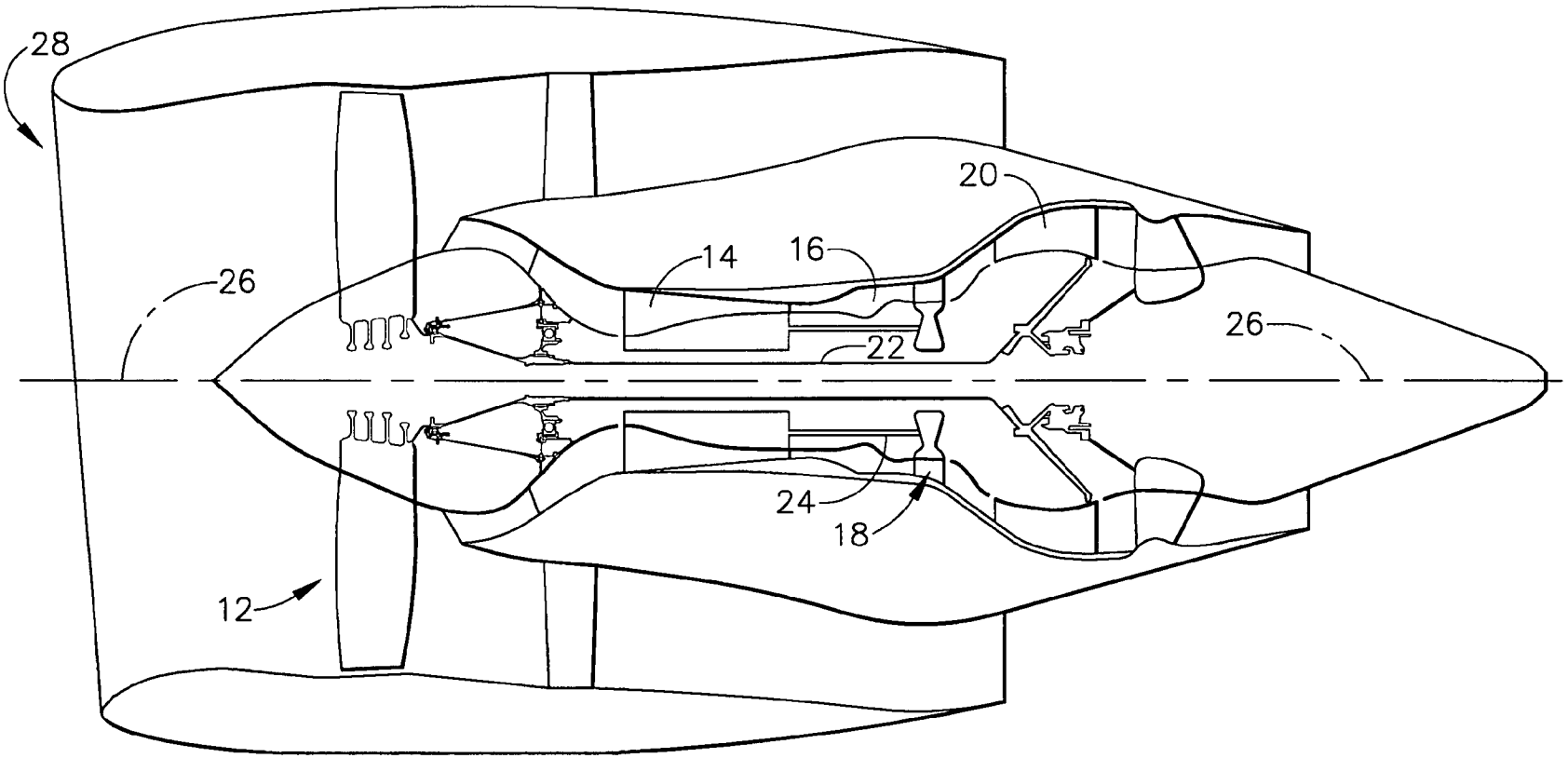
FIG. 1 is schematic illustration of an exemplary gas turbine engine.

FIG. 1 is a schematic illustration of a gas turbine engine 10 including a low, or intermediate, pressure compressor 12, a high pressure compressor 14, and a combustor assembly 16. Engine 10 also includes a high pressure turbine 18, and a low, or intermediate, pressure turbine 20 arranged in a serial flow relationship. Compressor 12 and turbine 20 are coupled by a first shaft 22, and compressor 14 and turbine 18 are coupled by a second shaft 24. Engine 10 includes an axis of rotation 26, which may be referred to herein as a "compressor rotation axis" and/or an "engine rotation axis", about which components of compressors 12 and 14 and turbines 18 and 20 rotate during operation of engine 10. In one embodiment, engine 10 is an LM6000 engine commercially available from General Electric Company, Cincinnati, Ohio.

In operation, air flows through low pressure compressor 12 from an upstream side 28 of engine 10 and compressed air is supplied from low pressure compressor 12 to high pressure compressor 14. Compressed air is then delivered to combustor assembly 16 where it is mixed with fuel and ignited. The combustion gases are channeled from combustor 16 to drive turbines 18 and 20.

Figure 2:
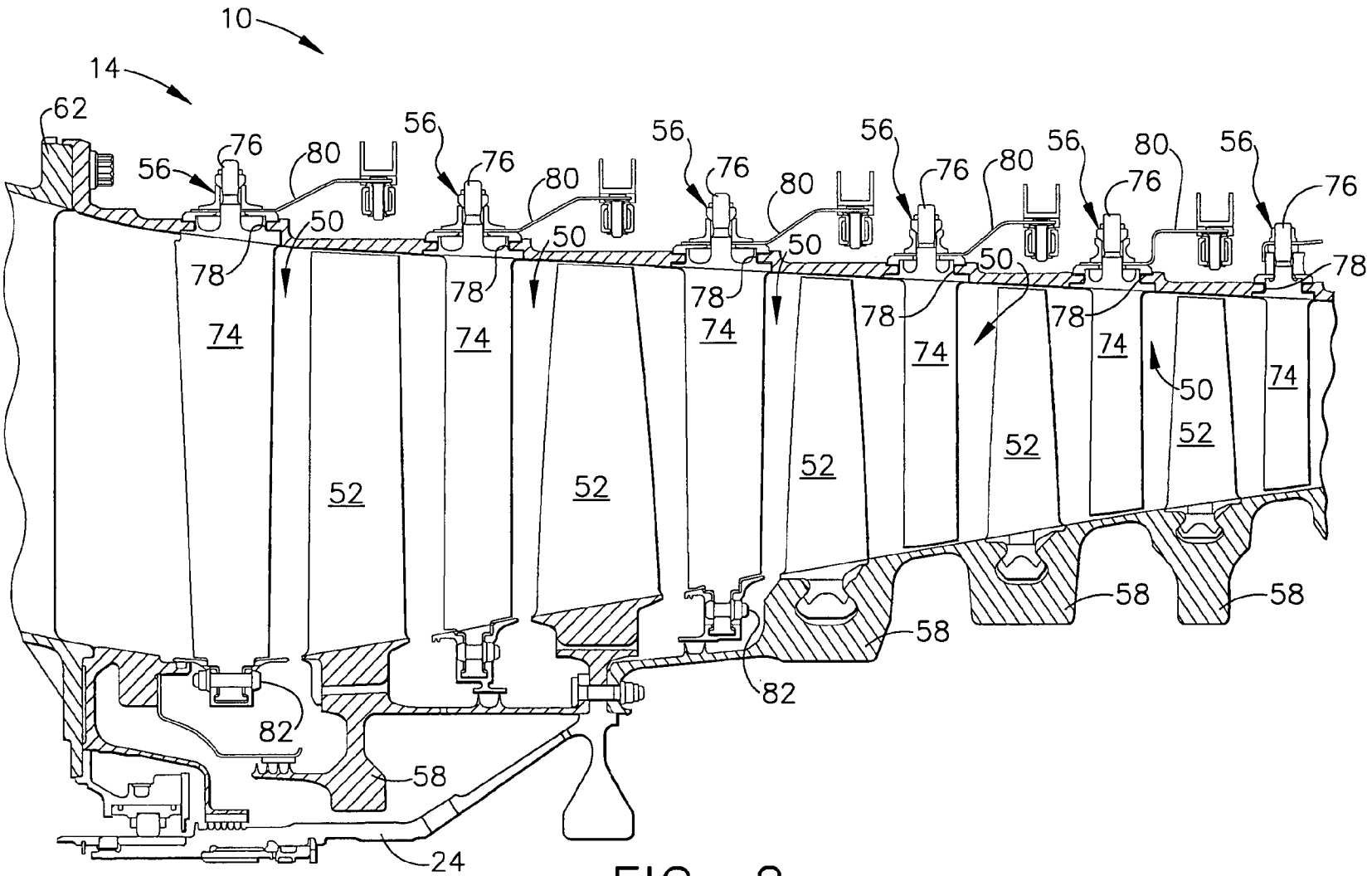
FIG. 2 is a schematic view of a section of an exemplary compressor for use with the gas turbine engine shown in FIG. 1.

FIG. 2 is a schematic view of a section of high pressure compressor 14. Compressor 14 includes a plurality of stages 50, wherein each stage 50 includes a row of rotor blades 52 and a row of variable stator vane assemblies 56. Rotor blades 52 are typically supported by rotor disks 58, and are connected to rotor shaft 24. Rotor shaft 24 is a high pressure shaft that is also connected to high pressure turbine 18 (shown in FIG. 1). Rotor shaft 24 is surrounded by a stator casing 62 that supports variable stator vane assemblies 56.

Each variable stator vane-assembly 56 includes a plurality of variable vanes 74 each having a respective vane stem 76. Vane stem 76 protrudes through an opening 78 in casing 62. Each variable vane assembly 56 also includes a lever arm assembly 80 extending from variable vane 74 that is utilized to rotate variable vanes 74. Vanes 74 are oriented relative to a flow path through compressor 14 to control air flow therethrough. In addition, at least some vanes 74 are attached to an inner casing 82.

Figure 3:
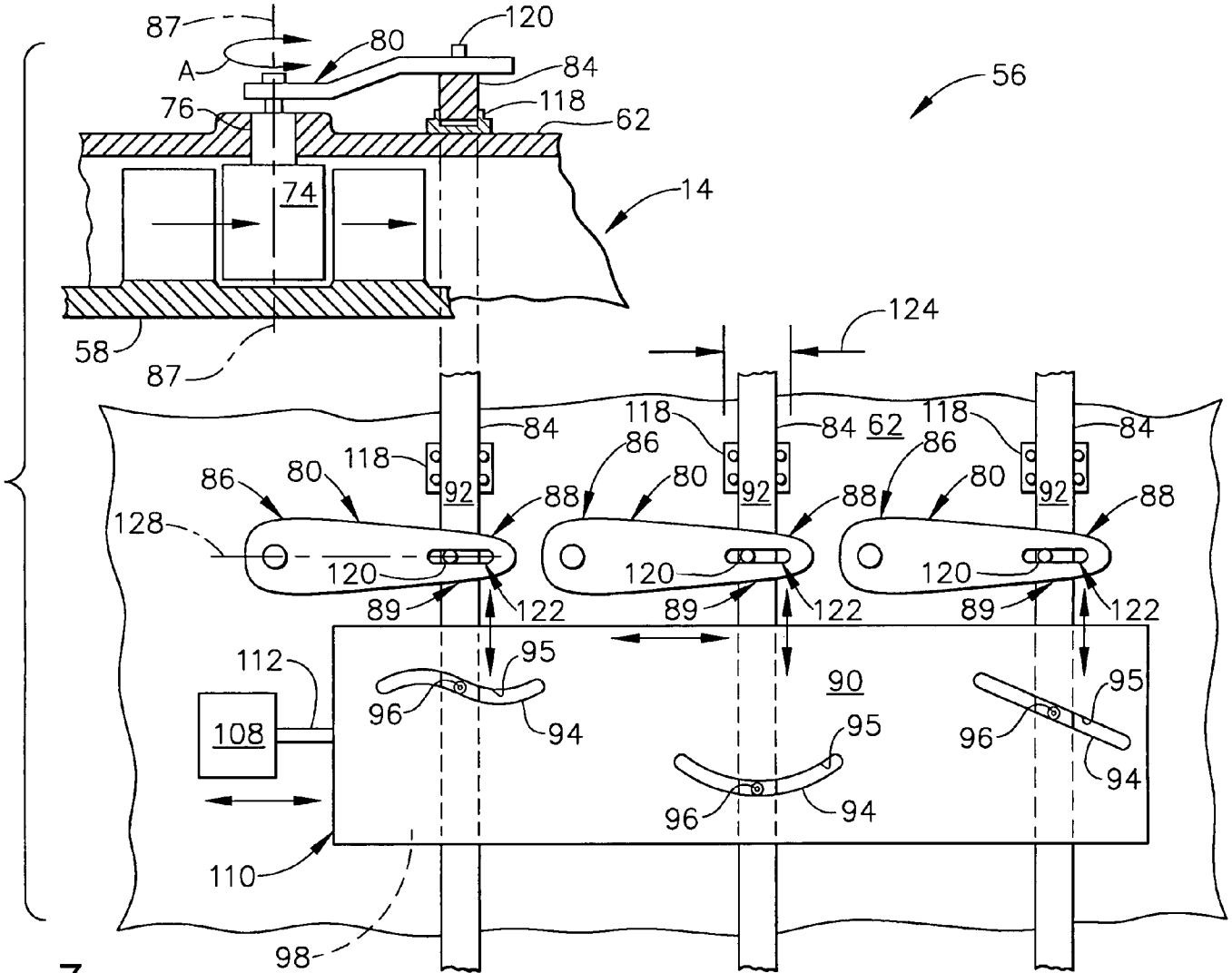
FIG. 3 is a partly sectional axial view of a variable stator vane assembly of the compressor shown in FIG. 2.
Figure 4:
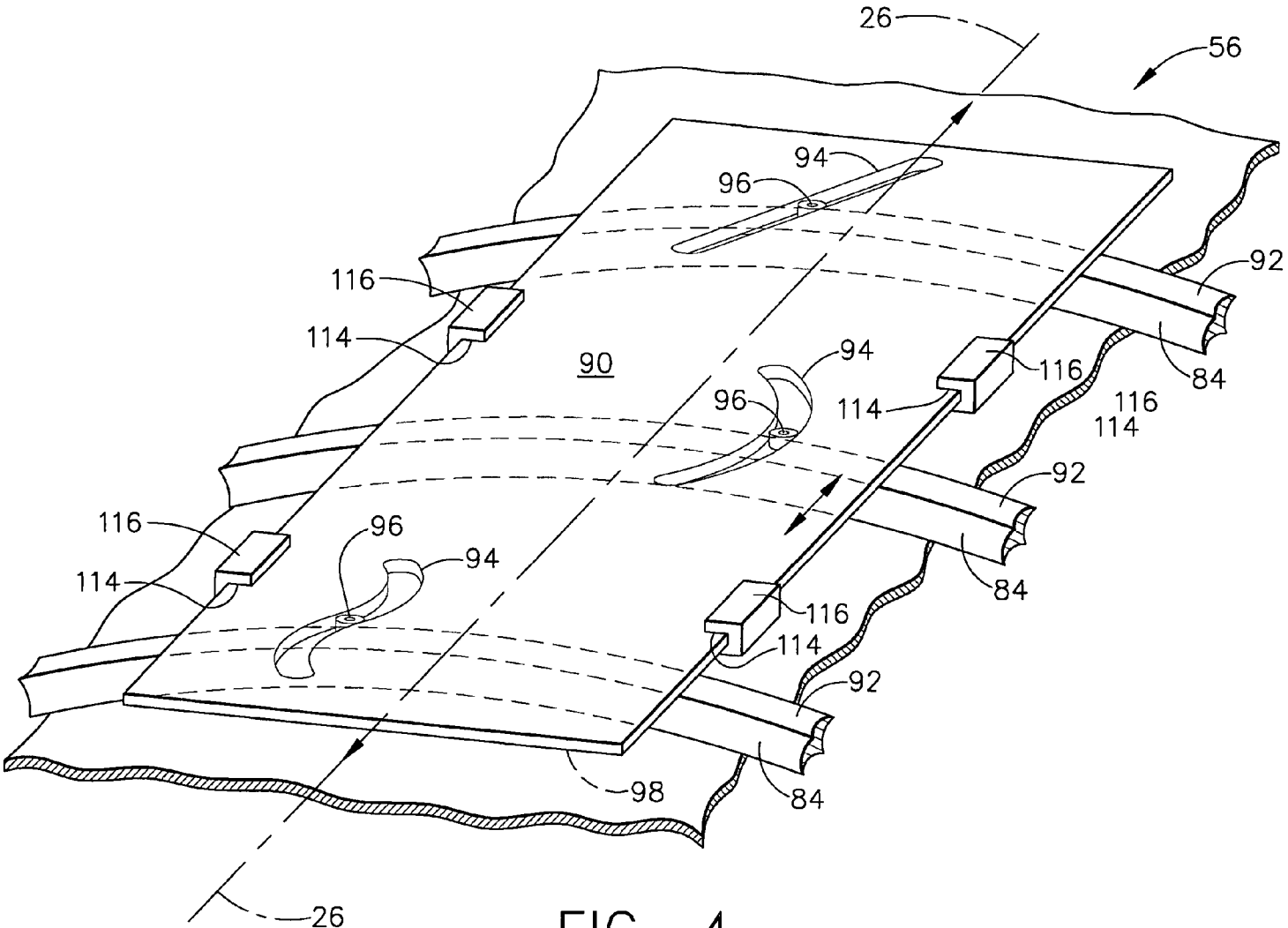
FIG. 4 is a perspective view of a portion of the variable stator vane assembly shown in FIG. 3.

FIG. 3 is a partly sectional axial view of a portion of variable stator vane assembly 56. FIG. 4 is a perspective view of a portion of variable stator vane assembly 56. To facilitate increasing efficiency of compressor 14 and/or maintaining a suitable stall margin, variable vanes 74 are selectively pivotable over a scheduled range of pivot angles A to correspondingly vary the orientation of individual vanes 74 relative to the flow of air through compressor 14. To facilitate pivoting vanes 74, each variable vane assembly 56 is coupled to an actuation ring 84 of the corresponding compressor stage 50. Each actuation ring 84 coaxially surrounds stator casing 62 adjacent lever arm assemblies 80 of the corresponding variable vane assembly 56. Although any suitable structure and/or means may be used, whether described and/or illustrated herein, in the exemplary embodiment each variable vane 74 is coupled to the corresponding actuation ring 84 utilizing lever arm assembly 80. More specifically, in the exemplary embodiment lever arm assembly 80 includes a first, or proximal, end 86 that is removably coupled to a corresponding variable vane 74, and a second, or distal, end 88 that is removably coupled to actuation ring 84. Lever arm assembly proximate ends 86 may each be coupled to the corresponding vane 74 using any suitable structure and/or means, whether described and/or illustrated herein. Similarly, lever arm assembly distal ends 88 may each be coupled to the corresponding actuation ring 84 using any suitable structure and/or means, whether described and/or illustrated herein, such as, but not limited to, a slip joint 89, as will be described in more detail below.

During operation, actuation ring 84 is rotated, which may also be referred to herein as translated, around engine rotation axis 26 (shown in FIG. 1). Because lever arm assembly 80 is coupled to actuation ring 84, translating actuation ring 84 about engine rotation axis 26 causes lever arm 80 to move vane stem 76, and thus variable vane 74 around a stator vane axis 87 that is about normal to engine rotation axis 26. Actuation rings 84 are translated about engine rotation axis 26 using a template 90. Template 90 is coupled to stator casing 62 for movement relative to casing 62. Although template 90 may be coupled to stator casing 62 for movement relative thereto in any direction and/or along any axis that enables template 90 to function as described and/or illustrated herein, in the exemplary embodiment template 90 moves along engine rotation axis 26. Template 90 is positioned relative to stator casing 62 such that template 90 extends over a radially outward surface 92 of one or more actuation rings 84. Although template 90 is illustrated as extending over three actuation rings 84, template 90 may extend over any number of actuation rings. Accordingly, template 90 may translate any number of actuation rings 84 about engine rotation axis 26.

In the exemplary embodiment, template 90 includes three elongate slots 94 extending therethrough. Each slot 94 receives a portion of an actuation pin 96 that extends radially outward from a corresponding actuation ring radially outward surface 92. Generally, as template 90 is moved along engine rotation axis 26, inner surfaces 95 of each slot 94 contact the corresponding actuation pin 96 causing pin 96 to move along slot 94 and thereby causing the corresponding actuation ring 84 to translate about engine rotation axis 26. In other words, each slot 94 guides movement of the corresponding actuation pin 96, which in turn rotates the corresponding actuation ring 84. Each slot 94 includes a shape and/or size that is configured to guide rotation of the corresponding actuation ring 84 between a predetermined scheduled range of pivot angles for the corresponding stator vanes 74 coupled thereto. As such, a shape and/or size of each of slots 94 can be predetermined to facilitate increasing an efficiency of compressor 14 and/or maintaining a suitable stall margin. Slots 94 may have any shape and/or size, whether described and/or illustrated herein, that enable slots 94 to function as described herein, for example to guide translation of the corresponding actuation ring 84 between a predetermined scheduled range of pivot angles for the corresponding stator vanes 74 coupled thereto. Examples of shapes of slots 94 include, but are not limited to, slots 94 including one or more curved portions and/or slots including one or more straight portions. Although three slots 94 are illustrated, template 90 may include any number of slots 94 for guiding rotation of any number of actuation rings 84.

In some embodiments, for example in addition or alternative to slots 94 and/or actuation pins 96, template 90 includes a pin (not shown) that extends radially inward from a radially inward surface 98 of template 90 and one or more of actuation rings 84 includes a slot (not shown) for receiving the pin. Similar to the exemplary embodiment, as template 90 is moved along engine rotation axis 26, each template pin contacts corresponding radially inner surfaces (not shown) of each actuation ring slot causing the template pin to move along the actuation ring slot and thereby causing the corresponding actuation ring 84 to translate about engine rotation axis 26. In other words, each actuation ring slot guides rotation of the corresponding actuation ring 84. Moreover, similar to the exemplary embodiment each actuation ring slot includes a shape and/or size that is configured to guide rotation of the corresponding actuation ring 84 between a predetermined scheduled range of pivot angles for the corresponding stator vanes 74 coupled thereto. As such, a shape and/or size of each of the actuation ring slots can be predetermined to facilitate increasing an efficiency of compressor 14 and/or maintaining a suitable stall margin. Other than their locations, the actuation ring slots and template pins are substantially identical to slot 94 and pin 96, respectively, and therefore will not be described in more detail herein. As they are substantially identical, anything described and/or illustrated herein with respect to slot 94 and/or pin 96 is applicable to the actuation ring slots and/or the template pins, respectively.

Figure 5:
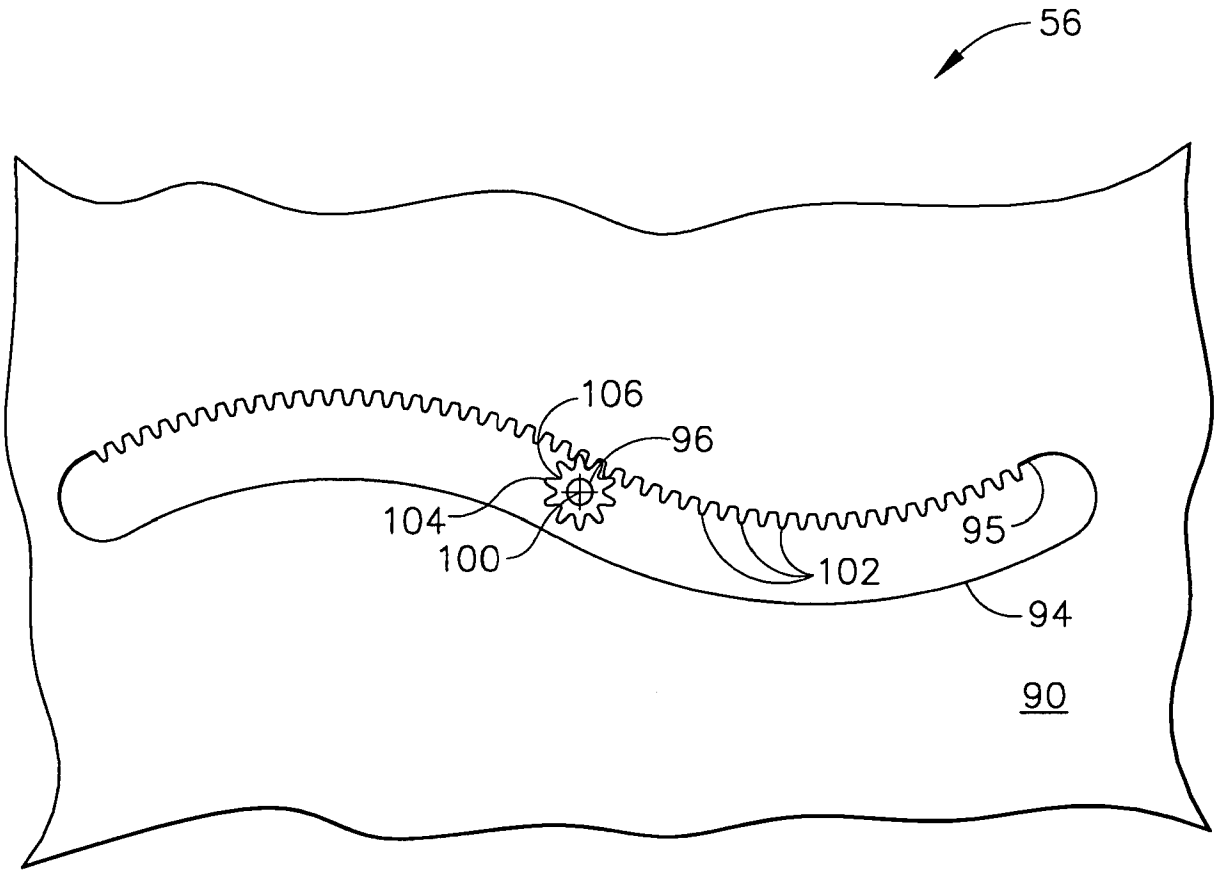
FIG. 5 is a top plan view of a portion of the variable stator vane assembly shown in FIG. 3.

FIG. 5 is a top plan view of a portion of variable stator vane assembly 56 illustrating an embodiment wherein one or more slots 94 and their corresponding actuation pins 96 include a plurality of teeth configured to interdigitate to facilitate movement of pins 96 within slots 94. More specifically, one or more actuation pins 96 are rotatably coupled to the corresponding actuation ring 84 for rotation relative thereto about a central longitudinal axis 100 of each pin 96. In the embodiment illustrated in FIG. 5, a portion of inner surfaces 95 of slot(s) 94 include a plurality of teeth 102 extending radially inward (relative to longitudinal axis 100) therefrom that interdigitate with a plurality of teeth 104 extending radially outward (relative to longitudinal axis 100) from a radially outer surface 106 of actuation pin(s) 96. Teeth 102 and 104 and the rotation of pin(s) 96 may facilitate movement of pin(s) 96 within the corresponding slot(s) 94 and, in some embodiments, may facilitate securing pin(s) 96 at one or more predetermined locations within the corresponding slot(s) 94 and thereby may facilitate securing the corresponding actuation ring 84 in one or more predetermined positions about engine rotation axis 26.

Referring again to FIGS. 3 and 4, movement of template 90 along engine rotation axis 26 may be driven by any suitable structure and/or means, such as, but not limited to electrical, pneumatic, and/or hydraulic power. In the exemplary embodiment, an actuator 108 is coupled to an end portion 110 of template 90 via an actuation rod 112. Movement of actuation rod 112 along engine rotation axis 26 causes movement of template along axis 26. Although template 90 may be coupled to stator casing 62 in any suitable other fashion, manner, configuration, arrangement, and/or by any other suitable structure and/or means, in the exemplary embodiment portions of template 90 are received within openings 114 of a plurality of retaining clips 116, which are coupled to stator casing 62. Retaining clips 116 may facilitate maintaining a general position of template 90 over one or more actuation rings 84. Moreover, retaining clips may facilitate guiding movement of template 90 along engine rotation axis 26.

A plurality of circumferentially spaced apart ring guides 118 are fixedly coupled to casing 62 for guiding circumferential movement (i.e. rotation/translation) of actuation rings 84 about engine rotation axis 26. More specifically, ring guides 118 facilitate restraining or limiting movement of actuation rings 84 along engine rotation axis 26 while guiding circumferential movement about axis 26. Although ring guides 118 may have any suitable configuration, arrangement, location, orientation, and/or may include any suitable structure and/or means, in the exemplary embodiment ring guides 118 are coupled to stator casing 62 on opposite axial sides of actuation rings 84. In the exemplary embodiment, ring guides 118 may include suitable rollers to facilitate reducing friction between guides 118 and actuation rings 84.

As discussed above, in the exemplary embodiment each lever arm assembly end 86 is coupled to the corresponding actuation ring 84 using a slip joint 89. However, in some embodiments some or all of lever arm assembly ends 88 are coupled to the corresponding actuation ring 84 without using a slip joint 89. Slip joints facilitate accommodating the limit or restraint of movement of actuation rings 84 along engine rotation axis 26 by varying a pivot length of lever arm assemblies 80 as actuation rings 84 are rotated about engine rotation axis 26. Slip joints 89 may also facilitate non-linear motion, or scheduling, between actuation rings 84 and their corresponding stator vanes 74, which may facilitate optimization and/or tailoring of scheduling of vanes 74. Although slip joints 89 may be any type of slip joint have any suitable arrangement, configuration, structure, and/or means, in the exemplary embodiment slip joints 89 include a pin 120 extending radially outwardly from actuation ring radially outer surface 92 and an elongate slot 122 within each lever arm assembly distal end 88. At least a portion of each pin 120 is received within a corresponding slot 122. As actuation rings 84 rotate about engine rotation axis 26 to vary the position of the corresponding lever arm assembly 80, pins 90 move within the corresponding slot 122 to vary the pivot length of the lever arm assembly 80. Each slot 122 has a suitable length 124 which allows the corresponding pin 120 to move between opposite ends of the slot 122 over the intended maximum range of rotation of the corresponding lever arm assembly 80. Because movement of actuation rings 84 along axis 26 is limited or restrained by ring guides 118, pins 120 generally remains in the same axial plane even as actuation rings 84 are rotated. Because lever arm assemblies 80 each rotate relative to stator vane axis 87, slots 120 may each facilitate preventing binding between a lever arm assembly 80 and the corresponding actuation ring 84 to facilitate allowing the lever arm assembly 80 to be turned over its full intended pivoting range, with the corresponding pin 120 sliding along slot length 124. Although as illustrated each slot 122 generally extends straight along a longitudinal axis 128 of the corresponding lever arm assembly 80, in some embodiments one or more of slots 122 are angled relative to axis 128, curved, and/or arcuate to further facilitate non-linear motion, or scheduling, between actuation rings 84 and their corresponding stator vanes 74. In addition or alternative to pins 120 and slots 122, one or more slip joints 89 may include a pin (not shown) extending from a lever arm assembly 80 and a slot (not shown) within a corresponding actuation ring 84.

During operation, as template 90 is moved along engine rotation axis 26, slot inner surfaces 95 contact the corresponding actuation pin 96 causing pin 96 to move along slot 94 and thereby causing the corresponding actuation ring 84 to translate about engine rotation axis 26. Because lever arm assembly 80 is coupled to actuation ring 84, translating actuation ring 84 about engine rotation axis 26 causes lever arm 80 to move vane stem 76, and thus variable vane 74 around stator vane axis 87. As template 90 moves along axis 26 to thereby rotate vanes 74, the size and/or shape of slots 94 guides rotation of the corresponding actuation ring 84 between a predetermined scheduled range of pivot angles for the corresponding stator vanes 74 coupled thereto.

The above-described variable stator vane assembly 56 may facilitate non-unidirectional scheduling of stator vanes 74. More specifically, at least some known vane schedules are determined as a function of corrected speed of the engine. For example, as the corrected speed of the engine increases, the stator vanes may be rotated to be generally more "open" relative to air flowing through the engine compressor. As the corrected speed of the engine decreases, the stator vanes may be rotated to be generally more "closed" relative to air flowing through the engine compressor. As such, at least some known vane schedules may be unidirectional relative to engine corrected speed. However, template 90, and for example slots 94, of variable stator vane assembly 56 may facilitate non-unidirectional scheduling of variable stator vanes 74. More specifically, the size and/or shape of template slots 94 may be configured to rotate stator vanes 74 such that they are generally more "open" as a corrected speed of engine 10 increases.

However, once the corrected speed of engine 10 increases above a predetermined threshold, the size and/or shape of slots 94 may be configured to rotate stator vanes 74 to be move "closed" as the corrected speed increases above the predetermined threshold. Similarly, the size and/or shape of template slots 94 may be configured to rotate stator vanes 74 such that they are generally more "closed" as a corrected speed of engine 10 decreases. However, once the corrected speed of engine 10 decreases below a predetermined threshold, the size and/or shape of slots 94 may be configured to rotate stator vanes 74 to be more "open" as the corrected speed decreases below the predetermined threshold. Accordingly, variable stator vane assembly 56 may facilitate non-unidirectional scheduling of variable stator vanes. Moreover, because a particular schedule of stator vanes 74 can be changed by changing template 90, variable stator vane assembly 56 may facilitate easier changing between different schedules as compared to at least some known variable stator vane assemblies.

Although the assemblies, systems, and methods described and/or illustrated herein are described and/or illustrated with respect to a gas turbine engine, and more specifically a gas turbine engine compressor, practice of the systems and methods described and/or illustrated herein is not limited to gas turbine engine compressors, nor gas turbine engines or compressors generally. Rather, the assemblies, systems, and methods described and/or illustrated herein are applicable to any variable stator vane assembly.

Exemplary embodiments of systems, assemblies, engines, and methods are described and/or illustrated herein in detail. The systems, assemblies, engines, and methods are not limited to the specific embodiments described herein, but rather, components of each system, engine, and assembly, as well as steps of each method, may be utilized independently and separately from other components and steps described herein. Each component, and each method step, can also be used in combination with other components and/or method steps.

When introducing elements/components/etc. of the systems, engines, assemblies, and methods described and/or illustrated herein, the articles "a", "an", "the" and "said" are intended to mean that there are one or more of the element (s)/component(s)/etc. The terms "comprising", "including" and "having" are intended to be inclusive and mean that there may be additional element(s)/component(s)/etc. other than the listed element(s)/component(s)/etc.

While the invention has been described in terms of various specific embodiments, those skilled in the art will recognize that the invention can be practiced with modification within the spirit and scope of the claims.

What is claimed is:

1. An actuation system for a plurality of variable stator vanes pivotally mounted in a casing of a compressor, said system comprising:

a plurality of levers each having a proximal end and an opposite distal end, each of said proximal ends fixedly coupled to a corresponding stator vane of the plurality of variable stator vanes for pivoting the corresponding stator vane about a stator vane axis;

an actuation ring coaxially surrounding the casing adjacent said plurality of levers, said actuation ring coupled to said distal ends of each of said plurality of levers for pivoting said levers as said actuation ring is rotated about a compressor rotation axis, said actuation ring comprising a pin extending outward from a radially outward surface of said actuation ring, said pin rotatably coupled to said actuation ring; and a template comprising a slot for receiving at least a portion of said pin, an inner surface of said slot interacts with an outer surface of said pin to convert rotational motion of said pin into translation of said pin said slot, said slot comprising a shape configured to guide rotation of said actuation ring about said compressor rotation axis when said template is moved relative to said actuation ring.

2. A system in accordance with claim 1 wherein said slot shape is configured to guide rotation of said actuation ring between a predetermined scheduled range of pivot angles of the stator vanes.

3. A system in accordance with claim 1 wherein said slot shape comprises a curve.

4. A system in accordance with claim 1 further comprising an actuator coupled to said template and configured to move said template relative to said actuation ring.

5. A system in accordance with claim 4 wherein said actuator is configured to move said template along said compressor rotation axis.

6. A system in accordance with claim 1 wherein said inner surface of said slot and said outer surface of said pin each comprise a plurality of teeth configured to interdigitate to convert rotational motion of said pin into translation of said pin in said slot.

7. A system in accordance with claim 1 wherein said plurality of levers is a first plurality of levers, said actuation ring is a first actuation ring, said actuation ring pin is a first pin, and said template slot is a first template slot, said system further comprises a second actuation ring coaxially surrounding the casing adjacent a second plurality of levers and comprising a second pin extending outward from a radially outward surface of said second actuation ring, wherein said template further comprises a second slot for receiving at least a portion of said second actuation ring pin, said second slot comprising a shape configured to guide rotation of said second actuation ring about said compressor rotation axis when said template is moved relative to said second actuation ring.

8. A system in accordance with claim 1 further comprising a ring guide coupled to the casing and said actuation ring for at least one of guiding rotation of said actuation ring about said compressor rotation axis and at least one of restraining and limiting movement of said actuation ring along said compressor rotation axis.

9. A system in accordance with claim 1 further comprising a plurality of slip joints each coupling said distal end of a corresponding lever of said plurality of levers to said actuation ring.

10. A compressor comprising:

a variable stator vane assembly comprising:

a plurality of variable stator vanes pivotally mounted in a casing of said compressor for rotation about a stator vane axis;

a plurality of levers each having a proximal end and an opposite distal end, each of said proximal ends fixedly coupled to a corresponding stator vane of said plurality of variable stator vanes for pivoting said corresponding stator vane about said stator vane axis;

an actuation ring coaxially surrounding said compressor casing adjacent said plurality of levers, said actuation ring coupled to said distal ends of each of said plurality of levers for pivoting said levers as said actuation ring is rotated about a compressor rotation axis, said actuation ring comprising a pin extending outward from a radially outward surface of said actuation ring, said pin rotatably coupled to said actuation ring; and a template comprising a slot for receiving at least a portion of said pin, an inner surface of said slot interacts with an outer surface of said in to convert rotational motion of said pin into translation of said pin in said slot, said slot comprising a shape configured to guide rotation of said actuation ring about said compressor rotation axis when said template is moved relative to said actuation ring.

11. A compressor in accordance with claim 10 wherein said slot shape is configured to guide rotation of said actuation ring between a predetermined scheduled range of pivot angles of said plurality of stator vanes.

12. A compressor in accordance with claim 10 wherein said slot shape comprises a curve.

13. A compressor in accordance with claim 10 further comprising an actuator coupled to said template and configured to move said template relative to said actuation ring.

14. A compressor in accordance with claim 13 wherein said actuator is configured to move said template along said compressor rotation axis.

15. A compressor in accordance with claim 10 wherein said inner surface of said slot and said outer surface of said actuation pin each comprise a plurality of teeth configured to interdigitate to convert rotational motion of said pin into translation of said pin in said slot.

16. A compressor in accordance with claim 10 wherein said plurality of levers is a first plurality of levers, said actuation ring is a first actuation ring, said actuation ring pin is a first pin, and said template slot is a first template slot, said system further comprises a second actuation ring coaxially surrounding said compressor casing adjacent a second plurality of levers and comprising a second pin extending outward from a radially outward surface of said second actuation ring, wherein said template further comprises a second slot for receiving at least a portion of said second actuation ring pin, said second slot comprising a shape configured to guide rotation of said second actuation ring about said compressor rotation axis when said template is moved relative to said second actuation ring.

17. A compressor in accordance with claim 10 further comprising a ring guide coupled to said compressor casing and said actuation ring for at least one of guiding rotation of said actuation ring about said rotation axis and at least one of restraining and limiting movement of said actuation ring along said compressor rotation axis.

18. A compressor in accordance with claim 10 further comprising a plurality of slip joints each coupling said distal end of one of said plurality of levers to said actuation ring.

19. A compressor in accordance with claim 10 wherein said stator vane axis is about normal to said compressor rotation axis.

20. An actuation system for a plurality of variable stator vanes pivotally mounted in a casing of a compressor, said system comprising:

a plurality of levers each having a proximal end and an opposite distal end, each of said proximal ends fixedly coupled to a corresponding stator vane of the plurality of variable stator vanes for pivoting the corresponding stator vane about a stator vane axis;

a template comprising a pin extending inward from a radially inward surface of said template, said pin rotatably coupled to said template; and an actuation ring coaxially surrounding the casing adjacent said plurality of levers, said actuation ring coupled to said distal ends of each of said plurality of levers for pivoting said levers as said actuation ring is rotated about a compressor rotation axis, said actuation ring comprising a slot for receiving at least a portion of said pin, an inner surface of said slot interacts with an outer surface of said in to convert rotational motion of said pin into translation of said pin in said slot, said slot comprising a shape configured to guide rotation of said actuation ring about said compressor rotation axis when said template is moved relative to said actuation ring.

* * * * *

UNITED STATES PATENT AND TRADEMARK OFFICE

CERTIFICATE OF CORRECTION

PATENT NO. : 7,413,401 B2
APPLICATION NO. : 11/333591
DATED : August 19, 2008
INVENTOR(S) : Szucs et al.

It is certified that error appears in the above-identified patent and that said Letters Patent is hereby corrected as shown below:

Column 7, line 4, delete "move" and insert therefor --more--.
Column 8, line 4, delete "pin said" and insert therefor --pin in said--.
Column 9, line 1, delete "said in" and insert therefor --said pin--.
Column 10, line 31, delete "said in" and insert therefor --said pin--.

Signed and Sealed this

Sixteenth Day of February, 2010

David J. Kappos

David J. Kappos
*Director of the United States Patent and Trademark Office*